US007086191B2

(12) United States Patent
Orr

(10) Patent No.: US 7,086,191 B2
(45) **Date of Patent: *Aug. 8, 2006**

(54) TRIGGER ASSEMBLY

(75) Inventor: Jeffrey George Orr, Corona, CA (US)

(73) Assignee: WGP, LLC, Bentonville, AR (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/798,725

(22) Filed: Mar. 11, 2004

(65) Prior Publication Data

US 2004/0237371 A1 Dec. 2, 2004

Related U.S. Application Data

(63) Continuation of application No. 10/072,321, filed on Feb. 7, 2002, now Pat. No. 6,705,036.

(51) Int. Cl.
*F41A 19/00* (2006.01)

(52) U.S. Cl. ..... 42/69.01; 89/1.42; 89/27.11; 124/31

(58) Field of Classification Search ..... 42/69.01; 89/1.42, 27.11; 124/31
See application file for complete search history.

(56) References Cited

U.S. PATENT DOCUMENTS 2,466,196 A * 4/1949 Baker ..... 42/69.01
4,067,309 A * 1/1978 Wohrstein ..... 124/67
4,173,964 A * 11/1979 Curran ..... 124/40
4,602,608 A * 7/1986 Lacam et al. ..... 124/74
4,727,670 A * 3/1988 Krouse ..... 42/69.01
5,149,898 A * 9/1992 Chesnut et al. ..... 42/69.01
5,634,456 A * 6/1997 Perrone ..... 124/76
5,718,074 A * 2/1998 Keeney ..... 42/69.03
5,884,615 A * 3/1999 Casas Salva ..... 124/71
6,189,525 B1 * 2/2001 Kutrubes ..... 124/31
6,347,622 B1 * 2/2002 Hsueh ..... 124/49
6,494,194 B1 * 12/2002 Shipachev et al. ..... 124/73

* cited by examiner

*Primary Examiner*—M. Clement
(74) *Attorney, Agent, or Firm*—Keisling Pieper & Scott PLC; David B. Pieper; Trent C. Keisling

(57) ABSTRACT

A trigger assembly comprises a trigger frame having a body with a cavity therein, a handle connected to the body, a trigger guard on the body defining a space with which a portion of the cavity is in communication, a connection member on the body, a slot member on the body, and abutment surfaces within the cavity. It also comprises a trigger pivotably mounted and movable within the trigger frame and comprising a body portion, a pivot connection means on the body portion connectable to the connection member of the body, a lever extending from the body portion for contact by a user, an engagement portion for engaging a firing mechanism to initiate discharge, and a rod connection means associated with the body portion for connecting the trigger to a rod to initiate re-arming.

16 Claims, 3 Drawing Sheets

FIG. 1
(Prior Art)
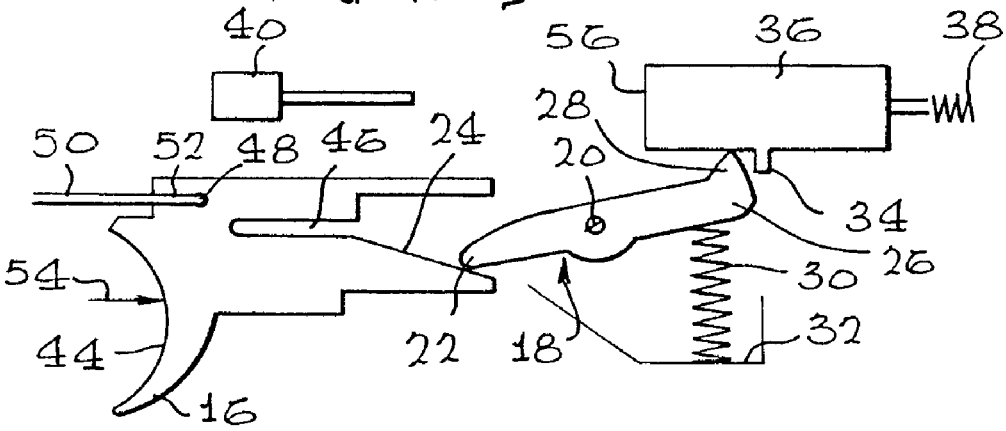
FIG. 2
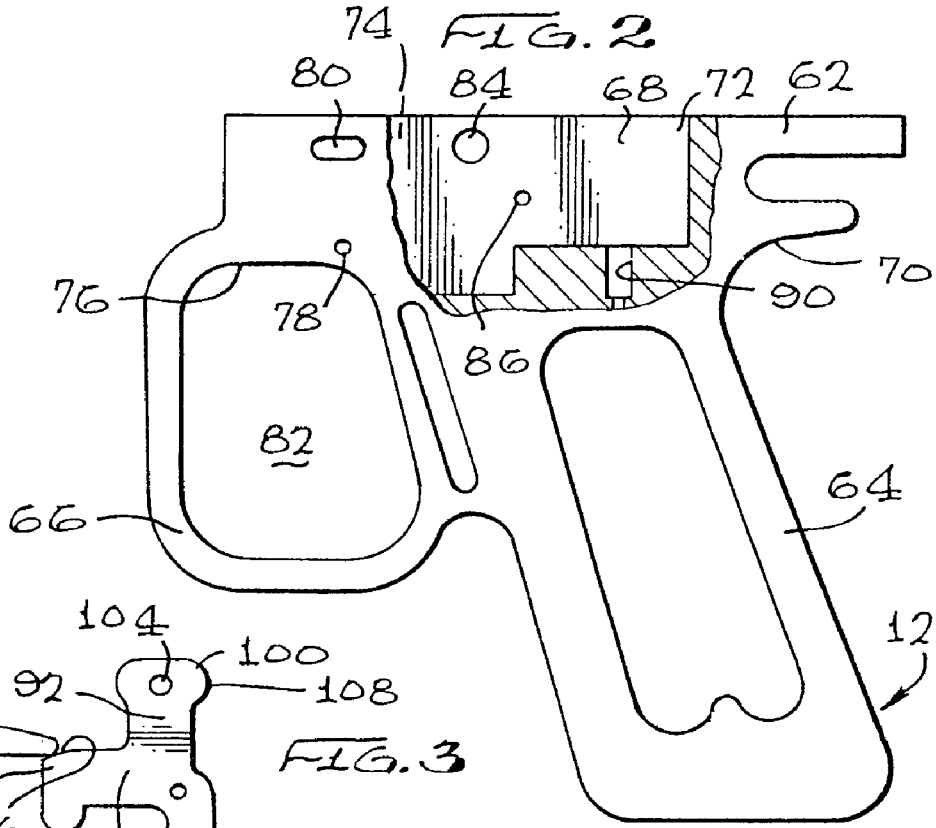
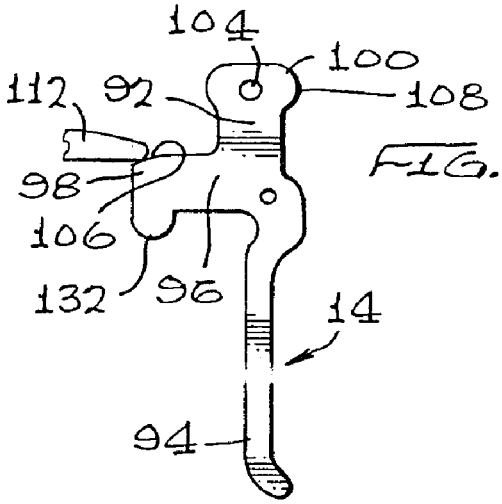
FIG. 3
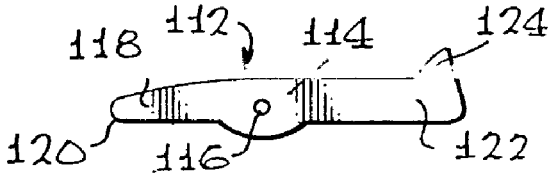
FIG. 4

FIG. 7
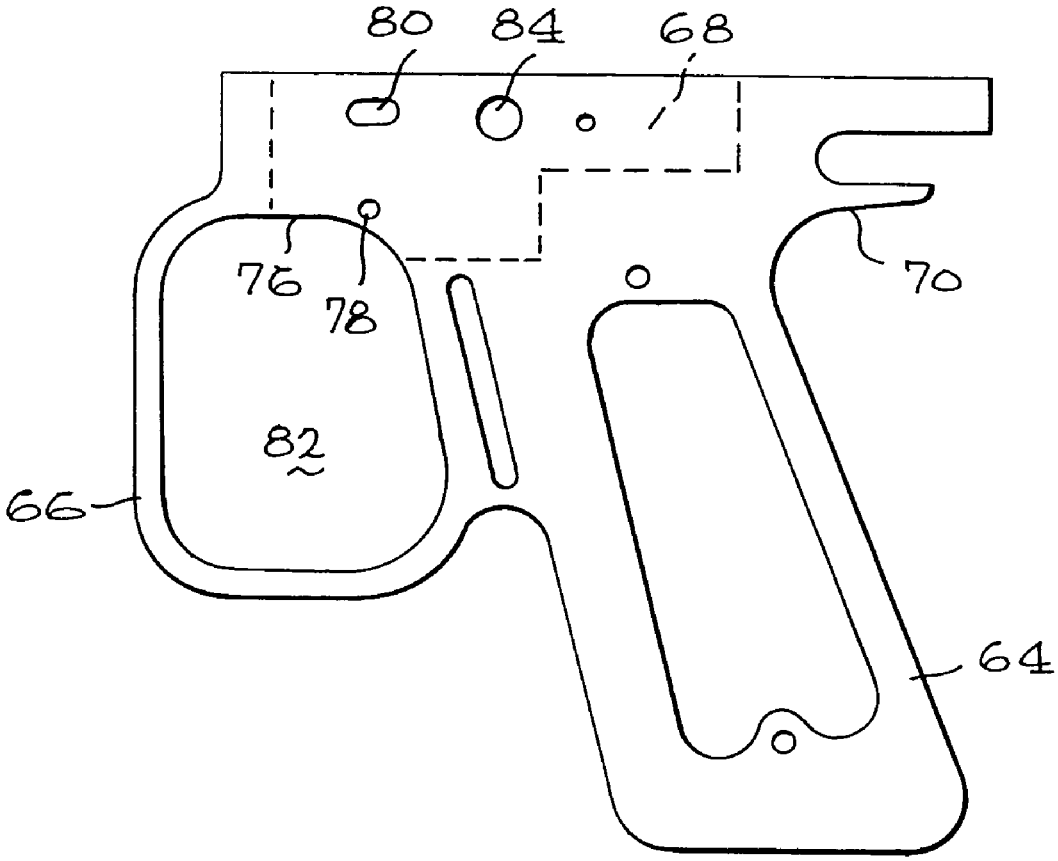
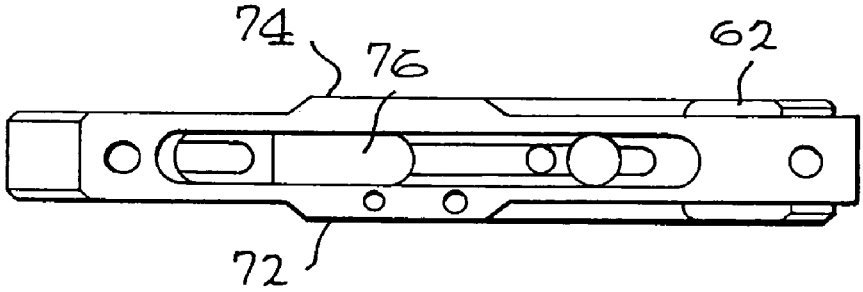
FIG. 8

TRIGGER ASSEMBLY

CROSS REFERENCE TO RELATED APPLICATIONS

This application is a continuation of U.S. patent application Ser. No. 10/072,321 filed Feb. 7, 2002, U.S. Pat. No. 6,705,036 issued Mar. 16, 2004, and which is incorporated herein by reference in its entirety.

FIELD AND BACKGROUND OF THE INVENTION

This invention relates to trigger assemblies. Typically, a trigger assembly comprises a trigger frame which forms part of a gun, the trigger frame being adapted for receiving the trigger, which is mounted within the trigger frame. The trigger frame may also accommodate other components, or portions thereof, of the gun or firing mechanism. More particularly, this invention relates to trigger assemblies comprising the trigger frame and trigger used in paint ball guns.

Most conventional guns, including paint ball guns, are activated by pulling or pressing a trigger mounted within the trigger frame. The trigger, accessed by a finger of the user, is typically in mechanical contact with a sear or other mechanism which is moved from a first to a second position by activation or pressing of the trigger. The movement of the sear sets in motion the firing of the bullet, paint ball or the like by activating the firing mechanism. In paint ball guns, the firing mechanism comprises a series of air or gas chambers, where gas is maintained under considerable pressure. The pulling of the trigger activates the firing, which releases, in a controlled manner, the gas under pressure, which in turn provides the necessary thrust for ejecting the paint ball from the barrel of the gun. The firing mechanism may also involve the recocking of the gun so that, at the end of the process, a further paint ball will be moved into the barrel for firing and the various gas compartments are pressurized for subsequent firings.

In conventional paint ball guns, a portion of the trigger is positioned within a trigger guard, which forms part of the trigger frame. The trigger is formed in a channel, and is constantly urged forwardly by the action of a spring. When the user wishes to fire the gun, the trigger is pulled backwards, and the entire trigger moves rearwardly in a linear fashion, against the action of the spring. In such guns, the entire trigger moves in linearly within the channel in a back and forth or reciprocating motion.

A portion of the trigger located within the trigger frame has a sloped or inclined surface in mechanical contact with the sear. As the trigger moves rearwardly in a linear plane, the sloped surface moves so as to cause one end of the pivotally mounted sear to rotate about a pivot pin, so that this one end of the sear moves up, and the opposite end moves down. The opposite end includes a catch which controls a hammer, and as the catch moves down, it releases the hammer which in turn initiates the firing process.

The trigger also activates an actuating rod which is a part of the mechanism that is responsible for the reloading or recocking of the gun. The trigger movement causes the actuating rod, which is attached to the trigger, to move linearly to initiate the reloading.

As mentioned, conventional triggers move back and forth in their entirety within the trigger frame so that the movement of the trigger, in contact with the actuating rod, operates in a one-to-one ratio so that the distance traveled by the movement of the entire trigger itself corresponds to the distance traveled by the actuating rod.

SUMMARY OF THE INVENTION

According to one aspect of the invention, there is provided a trigger for mounting in a trigger frame, the trigger comprising: a body portion; a pivot connection means on the body portion for connecting the trigger to the trigger frame so that the trigger is pivotable about the pivot connection means in the trigger frame; a lever extending from the body portion for contact by a user to move the trigger rotatably about the pivot connection means; an engagement portion associated with the body portion for engaging a firing mechanism to initiate discharge; and a rod connection means associated with the body portion for connecting the trigger to a rod to initiate cocking.

Preferably, the body portion comprises a central portion, the central portion having the pivot connection means located thereon, a head portion, the head portion having the rod connection means located thereon, and a ramp means on the engagement portion, the ramp means providing a surface for engaging a sear.

Preferably, the pivot connection means and the rod connection means are substantially vertically aligned with each other when the trigger is mounted in the trigger frame. The pivot connection means and the rod connection means may be approximately 0.625 inches apart.

According to another aspect of the invention, there is provided trigger frame for receiving a pivotally mounted trigger therein, the trigger frame comprising: a body having a cavity therein for receiving at least a portion of the trigger; a handle connected to the body; a trigger guard on the body, the trigger guard and body defining a space with which a portion of the cavity is in communication; a connection member on the body for securing a trigger in the cavity and space so that the trigger is pivotally movable; a slot member on the body to provide access from the outside of the trigger frame to a rod connection means on the trigger; and abutment surfaces within the cavity to limit the range of movement of the trigger when located in the body.

Preferably, the connection member comprises apertures and a pivot pin by means of which the trigger is pivotally connected to the body, a portion of the trigger being located in the cavity and another portion of the trigger extending from the cavity into the space defined by the trigger guard. Preferably, the connection member and the slot member are in a substantially vertical plane with respect to each other.

According to yet a further aspect of the invention, there is provided a trigger assembly comprising a trigger frame and a trigger for mounting on the trigger frame.

The present invention, in one aspect, is for a trigger assembly comprising a trigger mounted in a trigger frame, the trigger being pivotally mounted on the frame. Preferably, the trigger comprises an elongate portion for engagement by the user's finger or fingers, on one side of the pivot thereof, and an engagement portion on the other side of the pivot which, in use, is in contact with a sear or other corresponding portions of the firing mechanism of the gun, as well an actuating rod, for operation of the reloading process of the gun.

With particular reference to paint ball guns, the pulling of the trigger sets in motion and activates two separate processes. First, the pulling of the trigger results in the pivoting of the sear in contact therewith, which is moved against the bias of a spring, the movement of the sear in turn releasing a hammer which opens a valve. The opening of this valve releases compressed gas within the gun, which is specifically channeled to a position behind a paint ball located within the barrel of the gun, and thereby propels and discharges the paint ball from the gun.

The second operation set in motion by the pulling of the trigger is the activation of an actuating rod, the movement of which activates and opens a different series of pathways into which compressed air or gas in discharged in order to effect the automatic recocking and reloading of the gun. This second operation therefore has the effect of re-arming the firing mechanism and placing in position a further paint ball from a magazine in the gun, so that the next paint ball is ready for discharge.

These two operations, set in motion by the pulling or pressing of the trigger, must be carefully timed, and the construction of the gun components must therefore be configured to facilitate both of these operations. Clearly, the paint ball already within the barrel of the gun must be discharged before the new paint ball is loaded. Therefore, there should be a sufficient delay between the release of the hammer and the firing of the paint ball, and the re-arming of the gun, so as to locate a further paint ball from the magazine within the barrel. It is recognized that the gun should be constructed so that there is as little delay as possible between the firing of the paint ball and the automatic reloading of the new paint ball. To a significant extent, the construction and operation of the trigger within the trigger frame, which initiates both of these operations, plays an important role in the timing between the firing and cocking of the gun.

In accordance with one aspect of the invention, there is therefore provided a trigger assembly comprising a trigger mounted in a trigger frame, the trigger having a pivot point by means of which it is mounted in the frame. Extending from substantially one side of the pivot point, there is an activation lever for engagement by the user, and, extending in substantially an opposite direction there is an engagement surface for actuating the mechanism to discharge the paint ball, as well as a connection means adapted for connecting the trigger to an actuating rod.

Preferably, the connecting means for connecting to the actuating rod comprises an aperture in the trigger, and the trigger is configured so that the distance between the pivot point and the connecting means is optimal for moving the actuating rod to optimize the automatic recocking of the gun. As will be appreciated, the greater the distance between the pivot point and the connecting means, the greater will be the distance moved by the connecting means upon pulling of the trigger. Further, where the distance is greater, the movement of the connecting means becomes less arced and increasingly linear.

Preferably, the connecting means is an aperture for receiving an end of the actuating rod and which corresponds substantially in the vertical plane with the pivot pin. Since the actuating rod is substantially horizontal, this construction allows maximum movement of the actuating rod by the connecting means.

The trigger frame of the invention preferably comprises a conventionally shaped housing with a chamber therein, and an appropriately located trigger guard. A trigger extends between the space defined by the trigger guard, and into the chamber of the housing. The trigger is pivotally mounted within the housing, and a slot is provided in the housing at the location of the connecting means so that an end of the actuating rod, located outside the housing, can be secured to the connecting means.

A spring biases the trigger within the housing into a first or rest position, and a user urges the trigger against the bias of the spring so as to mechanically impact the mechanism, which results in the firing of the paint ball and the reloading of the gun.

The slot within the housing is of a dimension such that the aperture which comprises the connecting means is exposed to the outside of the housing along its full movement length as it operates between the first and second positions.

BRIEF DESCRIPTION OF THE DRAWINGS

FIG. 1 is a diagrammatic representation of a conventional paint ball gun trigger and related components;

FIG. 2 is a side view of a trigger frame in accordance with the present invention;

FIG. 3 is a side view of a trigger in accordance with the present invention;

FIG. 4 is a side view of a sear used in conjunction with a trigger of the present invention;

FIG. 7 is another side view, showing further details of the trigger frame of the present invention; and FIG. 8 is a top view of the trigger frame shown in FIG. 7 of the drawings.

DETAILED DESCRIPTION OF THE INVENTION

Figure 5:
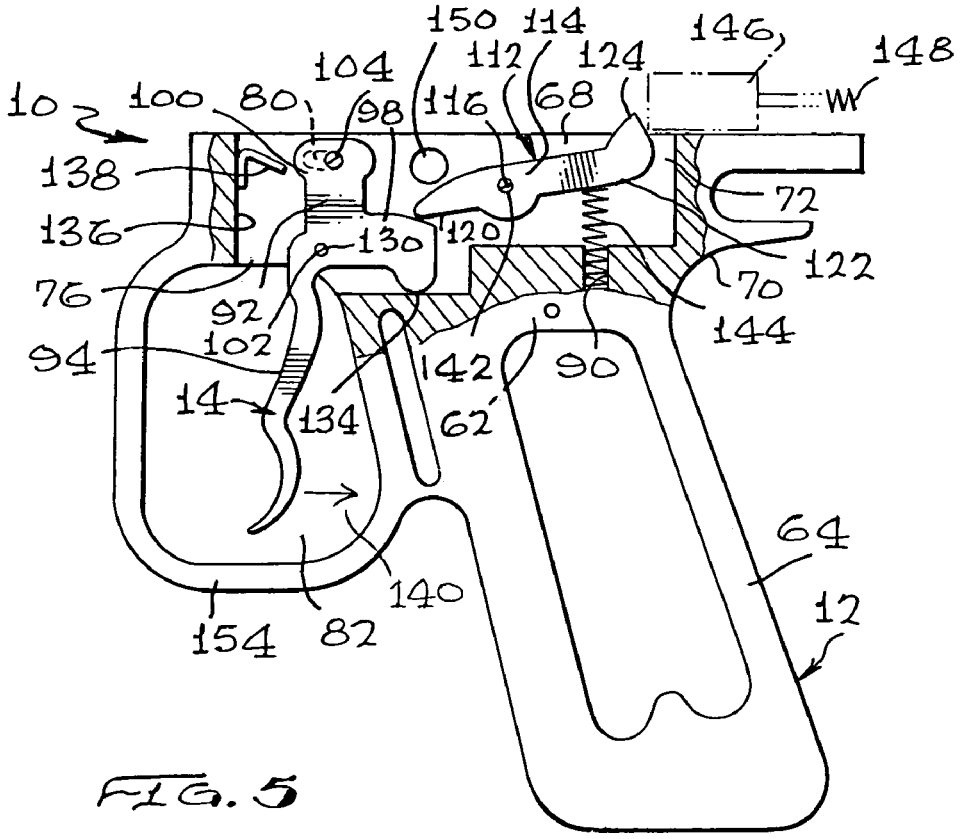
FIG. 5 is a side view, partly in section, of a trigger frame, trigger and sear, of the present invention, shown in a first or rest position before the trigger is pulled.

With reference to the drawings, there is shown in various illustrations a trigger assembly 10 of the invention which, in general terms, comprises a trigger frame 12 and a trigger 14 mounted on the frame.

FIG. 1 illustrates a typical trigger mechanism shown in the prior art, generally comprising a trigger 16, operatively and mechanically in contact with a sear 18. The sear 18 is mounted on a pivot 20, and rotates thereabout. The sear 18 has a first end 22 which is in contact with a ramp 24 constructed as part of the trigger 16. The sear 18 has a second end 26, the second end including a projecting catch 28.

The second end 26 of the sear 18 is urged upwardly by a sear spring 30, one end of which is mounted on the trigger frame 32 shown only in general outline in FIG. 1 of the drawings, with the other end in contact with the under surface of the second end 26 of the sear 18.

The projecting catch 28, when in the position shown in FIG. 1 of the drawings, engages a flange 34 formed as part of a hammer 36. The hammer 36 is normally urged by spring 38 towards a valve 40. However, the hammer 36 is held in check, except when the gun is fired, since it is stopped by the flange 34 abutting against the projecting catch 28 of the sear 18.

The trigger 16 includes a finger recess 44 designed to accommodate the user's finger. As mentioned, the trigger 16 further comprises an incline or ramp 24 upon which the first end 22 of the sear 18 rests. A slot 46 is formed in the trigger 16, by means of which it cooperates with the trigger frame 32 to ensure the smooth sliding and operation of the trigger 16, as will be briefly described.

The trigger 16 further comprises an aperture 48, and an actuating rod 50, having an end 52, is received within the aperture 48.

The trigger 16 is capable of sliding within the trigger frame 32 from its rest position shown in FIG. 1 of the drawings, to an activation position in the direction of arrow identified by reference numeral 54. In normal conditions, the trigger 16 is urged and rests in the position shown in FIG. 1 of the drawings. When the user is ready to activate the gun, the user's finger is placed in the finger recess 44, and the trigger 16 is pulled back in the direction of arrow 54. As the trigger 16 moves back, the first end 22 of the sear 18 rides up the ramp 24, causing the sear 18 to rotate about the pivot 20. As the first end 22 rises, the second end 26 is lowered, until such time as the projecting catch 28 no longer operates as an abutment to prevent further movement of the flange 34, and hence the hammer 38. When the very tip of the projecting catch 28 drops below the flange 34, the spring 38 forces the hammer 36 forward, and the face 56 of the hammer strikes the valve 40. The valve 40 opens a gas pathway, and the result is that compressed gas flows through predetermined channels in the gun to discharge a paint ball from the barrel. The various channels and travel direction of the compressed gas are not relevant to this invention, and will not be described further herein.

The movement of the trigger 16 in the direction of arrow 54 further has the effect of shifting the actuating rod 50, also in the direction of arrow 54. The actuating rod opens an activates various pathways permitting compressed air within the gun to automatically reload and recock, inserting a paint ball from a magazine in the barrel of the gun and pulling back the hammer to the position shown in FIG. 1 of the drawings. This procedure is also not considered pertinent to the invention, and will not be discussed further.

The trigger initiates two functions, namely, the firing of the weapon, followed immediately by the recocking thereof. It is therefore important that the various components, including the dimensions and shape of the trigger, must be carefully configured to ensure that the pulling of the trigger 16 results first in the firing of a paint ball from the weapon, followed by the recocking of the weapon with a further paint ball. At least to some extent, this is controlled by the configuration of the trigger 16, which initiates both of these processes.

Reference is now made to FIG. 2 of the drawings, which shows a side view of the trigger frame 12 of the invention. The trigger frame 12 comprises a body portion 62, a handle 64 and a trigger guard 66. The handle 64 extends downwardly and is adapted to receive handle covers (not shown) and is generally configured for the comfort and proper grip of the user.

The body portion 62 includes a hollowed out cavity 68 shown, for example, in FIG. 2, outlined in dotted lines. The body portion 62 further includes an arced abutment 70, which, in conventional fashion, functions to provide a comfortable and proper grip for the user.

The cavity 68 is define by a first lateral wall 72, also shown in FIG. 8 of the drawings, and a second lateral wall 74. The cavity 68 is open at the top, and also has an opening 76 at the upper area of the trigger guard 66. Each lateral wall 72 and 74 includes an aperture 78, the apertures 78 in each lateral wall 72 and 74 registering with each other. Further, each lateral wall 72 and 74 includes a horizontal slot 80, once more, each of the horizontal slots 80 in the first and second lateral walls 72 and 74 corresponding with each other for the purpose yet to be described. As will also be described further below, the cavity 68 is designed to accommodate a portion of the trigger 14, with the remaining portion extending out through the opening 76 and into the space 82 defined by the trigger guard 66.

A safety catch aperture 84 is formed in each one of the first and second lateral walls 72 and 74, so as to correspond with each other. Furthermore, a pivot pin aperture 86 is also formed within each of the first and second lateral walls 72 and 74, each of the pivot pin apertures 86 being in registry with each other.

In use, and as will be described below, a sear is also mounted and located within the cavity 68, and is biased into a first or rest position by a spring, to be described. A spring bore 90 is formed within the body portion 62 for this purpose.

Reference is now made to FIG. 3 of the drawings, which shows one embodiment of a trigger 14 of the invention, for use in a trigger frame as shown in FIG. 2 of the drawings. The trigger 14 comprises a body 92 and a downwardly depending lever 94 extending from the body 92. The body 92 comprises a central portion 96, a ramp portion 98, and an upper portion 100. The central portion 96 of the body 92 includes a pivot aperture 102, while the upper portion 100 has an actuating rod aperture 104. In use, and as will be described, the pivot aperture 102 aligns with the apertures 78 in the trigger frame 12, while the actuating rod aperture 104 aligns with the horizontal slot 80.

The ramp portion 98 includes a sear engaging surface 106 which is rounded, and over which the sear can move, as will be described, when the trigger 14 rotates about its pivot aperture 102. The upper portion 100 has a bulbous head 108, which, in use, engages a spring within the cavity 68 of the trigger frame 12, which urges the trigger 14 into its standard or rest position, as will be described.

FIG. 4 of the drawings illustrates a sear 112, the sear 112 having a central potion 114 and a pivot aperture 116 therein. Extending away from the central portion in one direction is a trigger engagement arm 118, having a trigger engagement surface 120 which, in use, cooperates with the sear engagement surface 106 of the trigger 14. The trigger engagement arm 118 has a rounded end so that it slides easily, and without catching on the sear engagement surface 106.

Extending in an opposite direction is a catch arm 122, which terminates in an upwardly projecting catch 124. The catch 124 will, in use, engage a hammer of the gun, in much the same way as is generally shown with reference to FIG. 1 of the drawings.

In use, the pivot aperture 116 aligns with the pivot pin apertures 86 in the first and second lateral walls 72 and 74 of the body portion 62 of the trigger frame 12. The pivoting therein of the sear 112 about the pivot aperture 116, which occurs in response to the movement of the trigger 14, causes the catch 124 to be raised or lowered respectively, thereby engaging or releasing the hammer in the gun to control the firing of the weapon.

Figure 6:
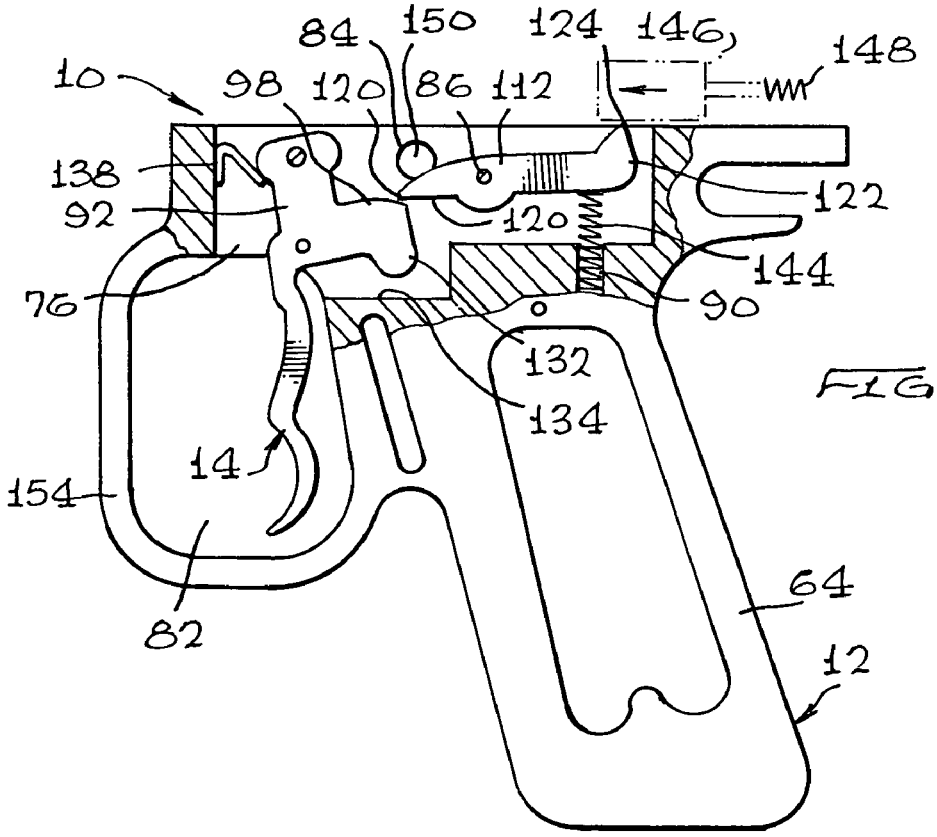
FIG. 6 is a side view, partly in section, of a trigger frame, trigger and sear, of the present invention, shown in a second or activated position after the trigger is pulled.

Reference is now made to FIGS. 5 and 6 of the drawings, which show a trigger frame 12 as illustrated in FIG. 2, with the trigger 14 and sear 112 mounted therein. FIG. 5 of the drawings shows the trigger and sear in a first or rest position, before the weapon has been fired, while FIG. 6 shows the same view, but with the trigger and sear in a second or activated position with the trigger pulled backwards and the sear pivoted so as to permit the firing of the weapon.

As will be noted, the body 92 of the trigger 14 is located within the cavity 68, while the lever 94 projects outwardly through the opening 76 of the cavity, into the space 82 defined by the trigger guard 66. The pivot aperture 102 is aligned with the apertures 78 in the first and second lateral walls 72 and 74 respectively, and a pivot pin 130 is inserted through apertures 78 and 102 so that the trigger 14 is mounted within the cavity 68, and is able to pivot about the pivot pin 130. With the trigger 14 so mounted, the actuating rod aperture 104 is positioned within the horizontal slot 80.

The trigger 14 is movable between a first position, in which rounded end 132 abuts the base 134 of the cavity 68, and a second position wherein the trigger 14 pivots about the pivot pin 130, until the bulbous head 108 abuts against the front end 136 of the cavity 68. The trigger 14 is thus movable between these extreme first and second positions. A spring 138 is mounted on the front end 136, and, in use, urges the upper portion 100 of the body 92 away from the front end 136, until such time as the rounded end 132 rests on the based 134. In this rest position, the lever 94 of the trigger 14 is biased towards a vertical component 154 of the trigger guard 66.

When the trigger 14 is pulled, it will move from the position shown in FIG. 5, against the action of the spring 138, until it can move no further. Upon release of the trigger 14, it will return from the position shown in FIG. 6, to that in shown in FIG. 5.

When the lever 94 is pulled in the direction of arrow 140, the ramp portion 98 thereof rotates about the pivot pin 130, and raises the trigger engagement arm 118 of the sear 112, so that the sear 112 pivots about pivot aperture 116. The sear 112 is mounted such that its pivot aperture 116 aligns with the pivot pin aperture 86, and is secured in position by means of a pivot pin 142.

The catch arm 122 is, in its natural state, urged upwardly by means of a spring 144. The spring 144 acts on the underside of the catch arm 122, opposite the catch 124, so that the catch 124 is urged upwardly, and projects above and into the bore occupied by the hammer 146. A hammer spring 148 generally urges the hammer 146 forward, but this movement is restrained when the catch 124 extends into the bore in which the hammer 146 is located.

The spring 144 is located within the spring bore 90 which extends to, and is accessible from the outside of the trigger frame 12, as shown, so that adjustments thereof can be made.

It will be noted that a safety catch 150 passes through the cavity 68, and is held in position in the safety catch apertures 84 in the first and second lateral walls 72 and 74 respectively. By shifting the safety catch 150, which has conventional larger diameter and smaller diameter portions, in a direction transverse to the axis of the gun, it can be located in a first position in which the smaller diameter portion is adjacent the sear 112 and the sear 112 is permitted to rotate about its pivot aperture 116, and a second position in which the larger diameter portion is adjacent the sear 112 to effectively prevent any movement thereof. Thus, when the safety catch 150 is in the second position and abuts against the sear to restrict its movement, inadvertent firing of the weapon will not be possible. A particular advantage of this type of safety catch 150 is that it prevents movement of the sear itself, as opposed to conventional systems where the safety catch prevents movement of the trigger. Since the sear may potentially move even when the trigger is secured, the securing of the sear itself is considered to be an added safety feature of the invention. The particular configuration of the trigger 14 and sear 112, and their pivotal movements, facilitates the use of a safety catch 150 which engages the sear 112.

The operation of the gun, insofar as its firing and reloading is concerned, will now be described, paying particular attention to the function and operation of the trigger assembly 10 in carrying out these procedures.

The operation of the trigger assembly 10 comprising the trigger 14 mounted within the trigger frame 12 can be readily inferred from the structure and interrelationship of the various components, as already described. An overview of this operation will be provided, and is principally illustrated in FIGS. 5 and 6 of the drawings. FIG. 5 shows the standard or rest position, while FIG. 6 shows the components in the activated or firing position.

In use, the user grasps the handle 64, and one or more fingers are inserted into the space 82 defined by the trigger guard 66. One or more fingers engage the lever 94, which is generally urged forward, towards the vertical component 154 of the trigger guard 66. It will be noted that the trigger 14 of the invention allows the user to use not only one finger on the lever 94, but two or more. In turn, this allows for better control and manipulation of the trigger, as well as steadier operation of the gun itself, when fired by the user.

As shown in FIG. 5, the spring 138 biases the upper portion 100 of the trigger 14 away from the front end 136. At this resting position, further rotational movement of the trigger 14 is prevented by the rounded end 132 abutting upon the base 134 of the cavity 68. The trigger 14 is further positioned such that its actuating rod aperture 104 is located at the rear end of the horizontal slot 80. In use, the actuating rod aperture 104 will receive an end of the actuating rod, not shown in FIGS. 5 and 6, but indicated in the illustration in FIG. 1 of the drawings. At the rest position, the sear engagement surface 106 of the ramp portion 98 is in contact with the trigger engaging surface 120 of the sear 112.

The sear 112 itself is mounted within the cavity 68 by passing the pivot pin 142 through pivot pin apertures 86 in the trigger frame 12, which apertures are aligned with the pivot aperture 116 in the sear. The sear 112 is therefore capable of rotational movement about the pivot pin 142. The spring 144 urges the catch arm 122 upwards so that the catch 124 projects into the bore in which the hammer 146 reciprocates.

When the user is ready to fire the weapon, the lever 94 is pulled backward, or away from the vertical component 154 of the trigger guard 66. As the lever 94 is pulled backwards, the trigger 14 rotates about the pivot pin 130, and the upper portion 100 thereof moves forwardly against the action of the spring 138 which is therefore compressed by the pulling action on the lever 94. Further, as the trigger 14 rotates about the pivot pin 130, the ramp portion 98 rises, and the trigger engagement surface 120 of the sear 112 riding over the sear engagement surface 106 causes the sear 112 to rotate in a clockwise direction, about the pivot pin 142. Thus, as the trigger engagement arm 118 rises as the trigger lever 94 is pulled, the catch arm 122 lowers against the action of the spring 144. Eventually, the sear 112 will rotate to the point where catch 124 is outside of the bore, allowing the hammer 146 to move forward by the action of the spring 148. The forward movement of the hammer 146 opens a valve, setting in motion the discharge of compressed gas, which fires the paint ball.

During movement of the lever 94 of the trigger 14 from its resting position as shown in FIG. 5, to the full firing position as shown in FIG. 6, the actuating rod aperture 80 moves from the right hand side of the horizontal slot 80 to the left hand side thereof. As the actuating rod aperture 104 moves within the slot, it shifts the actuating rod itself, which in turn initiates the automatic recocking and reloading of a new paint ball in the barrel of the gun. As mentioned above, the timing between release of the hammer 146 by lowering of the catch 124, and the effects of the actuating rod, are carefully controlled so that the sequential timing of the firing and reloading operations are optimized for maximum effectiveness.

When the lever 94 of the trigger 14 is released by the user, the trigger will be returned to its reset position as shown in FIG. 5 by the action of the spring 138. As the trigger 14 returns to its rest position, the ramp portion 98 will be lowered as the trigger 14 pivots about pivot pin 130, and the sear 112 will itself be rotated about pivot pin 142 by the action of the spring 144. The catch 124 will once more project into the bore to form an abutment for the hammer 148 to prevent the firing until such time as the trigger 14 is again pulled, as described.

An innovative feature of the present invention is the location and operation of the safety catch 150. As described, conventional gun components include a safety catch which usually prevents movement of the trigger. While the trigger may be fixed thereby, there is still a possibility that the sear may be capable of further movement, and may inadvertently be shifted to initiate the firing of the weapon. The present invention locates the safety catch 150 so that, when the gun is in the locked position, the sear will be prevented from any further movement.

Since the trigger 14 of the invention is pivotally mounted within the trigger frame 12, the distance and relationship between the pivot aperture 102 and the actuating rod aperture 104 on the trigger 14, as well as their corresponding positions on the trigger frame 12, become important in designing a mechanism for optimal operation. Since the trigger 14 pivots about pivot aperture 102, it is desirable that the actuating rod aperture 104 be sufficiently distanced from the pivot aperture 102 so that the movement of the actuating rod aperture 104 as the trigger 16 pivots or rotates is increasingly linear, as opposed to arc-shaped. Further, where the distance between the pivot aperture 102 and actuating rod aperture 104 is greater, the movement of the trigger 14 from the rest position to the firing position results in increased travel of the actuating rod aperture 104, enhancing the effectiveness of the actuating rod in initiating its function of recocking. In one specific embodiment, it has been found that the distance between the pivot aperture 102 and actuating rod aperture 104 of 0.625 inches, or five eighths of an inch, allows efficient operation without unduly or uncomfortably increasing the dimensions of the body portion 62 of the trigger frame 12.

Another preferred feature of the trigger assembly 10 of the invention is that the pivot aperture 102 and actuating rod aperture 104 should be in a substantially vertical plane. As will be appreciated, where the actuating rod aperture 104 is substantially vertically above the pivot aperture 102, the pivoting of the trigger 14 will maximize movement of the actuating rod aperture and hence the actuating rod itself which is in a substantially horizontal plane or generally transverse to the plane between the pivot aperture 102 and actuating rod aperture 104. Conversely, as the position of the actuating rod 104 moves away from the vertical plane through the pivot aperture 102, there will be a increasing reduction in the extent of horizontal movement of the actuating rod when the trigger 14 is activated.

Another advantage of the trigger assembly of the invention is the ability of the user, to a certain extent, to determine the "trigger pull" as desired. Since the trigger 16 operates through the pivoting thereof, it will be appreciated that a shorter trigger pull is required for activation when the lever 94 is pressed near the upper end thereof (or closer to the opening 76), while a longer trigger pull is required for activation when the lever 94 is held near its free end. Using these positions, as well as all of those between, assists the user in achieving more readily a desired firing rate, which can be increased or decreased according to where the lever 94 of the trigger 16 is held.

Further, the lever 94 can be held using one, two or more fingers, as opposed to the single finger operation typical in conventional triggers. This provides additional steadiness and enhanced operation of the gun.

A further important factor of the pivoting trigger 14 is that it is constructed with the various apertures and surfaces initiating both the firing and reloading. Thus, the trigger 14 of the invention is in mechanical contact and operation with both the sear 112, which initiates the firing, as well as the actuating rod, which initiates recocking and reloading of the gun with a further paint ball.

The structure and positioning of the actuating rod aperture 104 on the trigger 14, as well as variations thereof, allow for customizing of the gun operation, as desired. In conventional sliding triggers, the amount of movement of the actuating rod corresponds substantially with the amount of movement of the trigger, generally at a one-one ratio. On the other hand, the trigger of the present invention allows the amount of movement of the actuating rod aperture (and hence the actuating rod) to be determined according based on its distance from the pivot aperture 102. As the actuating rod aperture 104 is placed at an increased distance from the pivot aperture 102, the amount of movement of the actuating rod aperture 104 will be increased. The converse also applies. This feature enables a trigger 14 to be constructed so as to further fine tune the timing between the critical firing and reloading initiation effected by movement of the trigger 14.

The pivotal mounting of the trigger 14 within the trigger frame 12 also allows the custom design and function of the sear operation. The present invention facilitates increased contact areas between the trigger and the sear. In conventional systems where the entire trigger slides back and forth within the trigger frame, the trigger itself must be moved a considerable distance before the sear will be sufficiently moved or rotated to release the hammer. With the trigger of the present invention, it is possible to custom design and construct the various components so that the trigger is moved a lesser distance in order to operate the sear. Thus, conventional triggers will require that it be moved all the way back before the sear is sufficiently rotated to release the hammer, while the trigger of the invention can be constructed so that the sear will be sufficiently moved when the trigger is, for example, halfway through its movement cycle. Of course, a potential advantage is the ability to construct the trigger to have dimensions and a configuration which will vary these factors to suit the user's preferences.

The invention is not limited to the precise details described herein.

The invention claimed is:

1. A trigger for mounting in a trigger frame, the trigger comprising:

a body portion with a back;

a pivot connection on the body portion for connecting the trigger to the trigger frame so that the trigger is pivotable about the pivot connection in the trigger frame;

a lever extending from the body portion for contact by a user to move the trigger rotatably about the pivot connection;

an engagement portion extending from the back of the body portion, the engagement portion associated with the body portion for engaging a firing mechanism to initiate discharge;

a rod connection associated with the body portion for connecting the trigger to a rod to initiate cocking;

wherein the body portion comprises a central portion, the central portion having the pivot connection located thereon, a head portion, the head portion having the rod connection located thereon, and a sliding engagement ramp on the engagement portion, the sliding engagement ramp providing a surface for engaging a sear.

2. A trigger as claimed in claim 1 wherein the pivot connection comprises an aperture extending through the body portion.

3. A trigger as claimed in claim 1 wherein the rod connection comprises an aperture in the body portion.

4. A trigger as claimed in claim 1 wherein the head portion and the engagement portion each have abutment surfaces for abutting the trigger frame to limit the extent of movement of the trigger within the trigger frame.

5. A trigger as claimed in claim 1 wherein the pivot connection and the rod connection are substantially vertically aligned with each other when the trigger is mounted in the trigger frame.

6. A trigger as claimed in claim 1 wherein the pivot connection and the rod connection are approximately 0.625 inches apart.

7. A trigger as claimed in claim 1 wherein the lever is an elongate, flat arm of sufficient length so that at least two fingers of the user can be wrapped around the arm.

8. A trigger as claimed in claim 1 wherein the distance between the pivot connection and the engagement portion is configured so that the firing mechanism will be initiated when the trigger has been pulled a predetermined distance.

9. A trigger frame for receiving a pivotally mounted trigger therein, the trigger frame comprising:

a body having a cavity therein for receiving at least a portion of the trigger;

a handle connected to the body;

a trigger guard on the body, the trigger guard and body defining a space with which a portion of the cavity is in communication;

a connection member on the body for securing a trigger in the cavity and space so that the trigger is pivotally movable;

the trigger having a back and an engagement portion extending from the back of the trigger;

a slot member on the body to provide access from the outside of the trigger frame to a rod connection on the trigger;

abutment surfaces within the cavity to limit the range of movement of the trigger when located in the body.

10. A trigger frame as claimed in claim 9 wherein the connection member comprises apertures and a pivot pin by means of which the trigger is pivotally connected to the body, a portion of the trigger being located in the cavity and another portion of the trigger extending from the cavity into the space defined by the trigger guard.

11. A trigger frame as claimed in claim 9 wherein the slot member is an elongate horizontal slot positioned substantially over, and in a vertical plane with, the connection member.

12. A trigger frame as claimed in claim 11 wherein the horizontal slot is dimensioned so as to be of just sufficient length to expose to the outside of the body the rod connection in all positions along its movement of travel when the trigger is pivoted in the body.

13. A trigger frame as claimed in claim 9 wherein the connection member and the slot member are positioned approximately 0.625 inches from each other.

14. A trigger frame as claimed in claim 9 further comprising a sear connection member for pivotally mounting a sear within the cavity, the connection member for securing the trigger and the sear connection member being spaced from each other so that the trigger and sear are able to engage each other during firing.

15. A trigger frame as claimed in claim 9 further comprising a safety catch, the safety catch being positioned on the body and with respect to the cavity so as to releasably engage the sear.

16. A trigger frame as claimed in claim 15 wherein the safety catch comprises at least one aperture in the body, and a catch member movably mounted within the aperture and extending through the cavity, the catch member being movable between a lock position where it prevents movement of the sear, and an unlocked position where it permits movement of the sear.

* * * * *